United States Patent [19]

Pilley et al.

[11] 4,165,595

[45] Aug. 28, 1979

[54] PACKAGING MACHINES

[75] Inventors: Terence W. J. Pilley, Waltham Cross; Ronald A. Smith, Modbury; Joseph F. Middleton, New Barnet, all of England

[73] Assignee: Metal Box Limited, Reading, England

[21] Appl. No.: 857,577

[22] Filed: Dec. 5, 1977

[51] Int. Cl.[2] ..... B65B 53/00

[52] U.S. Cl. ..... 53/556; 53/567; 53/574

[58] Field of Search ..... 53/545, 556, 567, 570, 53/574, 258, 261, 384

[56] References Cited

U.S. PATENT DOCUMENTS

| | | | |
|---|---|---|---|
| 2,982,068 | 5/1961 | Pape et al. | 53/183 X |
| 3,201,914 | 8/1965 | Lohse et al. | 53/187 |
| 3,557,526 | 1/1971 | Hartmann | 53/183 |
| 3,774,367 | 11/1973 | Lerner | 53/261 X |

*Primary Examiner*—Horace M. Culver
*Attorney, Agent, or Firm*—Diller, Ramik & Wight

[57] ABSTRACT

A packaging machine is described in which articles or groups of articles are wrapped in a sleeve of stretch-wrap material. The machine includes a sleeve feeding and cutting assembly for drawing the leading end portion from a roll of stretch-wrap tubing, for opening the leading end, and for severing the leading end portion from the remainder of the roll to form a sleeve. A gripping assembly grips the open leading end and draws the sleeve onto a pair of relatively movable stretching plates. The plates are movable apart to stretch the sleeve to a size greater than the article or group of articles that it is required to wrap. A pusher is arranged to push the article or group of articles into the stretched sleeve. A discharge assembly is arranged to draw the sleeve and article or articles in unison away from the stretching plates.

8 Claims, 8 Drawing Figures

PACKAGING MACHINES

BACKGROUND OF THE INVENTION

1. Field of the Invention

The present invention relates to packaging machines for packing an article or group of articles in a sleeve of stretch wrap material.

2. Description of the Prior Art

Machines for wrapping articles in sleeves of plastics film are known. Where a number of articles are packed in the same sleeve, it has been found that, in transit, such articles are subject to damage because they can move relative to one another. To reduce such damage machines have been proposed which heat-shrink the sleeve onto the articles. Such machines have a number of disadvantages in so far as the articles may be damaged by the application of the heat and the strength of the sleeve may be adversely affected.

It is an object to provide an improved packaging machine.

It is a further object of the invention to provide a packaging machine which wraps articles in a sleeve in such a way as to prevent relative movement between the articles and to provide a strong and economical wrapping for the articles.

SUMMARY OF THE INVENTION

According to the invention there is provided a packaging machine comprising means for receiving a sleeve of stretch wrap material and opening it at one end, sleeve stretching means for entering the open end of the sleeve and operable to stretch the sleeve to a size sufficient to accommodate an article or pack to be wrapped by the sleeve, means for moving the article or pack relative to the stretching means so that the article or pack is accommodated within the sleeve, gripping means for gripping both the article or pack and the sleeve and control means for moving the gripping means and stretching means relative to one another to free the sleeve wrapped article or pack from the stretching means.

According to the invention there is further provided a packaging machine for wrapping a pack or article in a stretch-wrap sleeve, comprising a sleeve feeding and cutting assembly for drawing the leading end portion from a supply of stretch-wrap tubing, for opening the leading end, and for severing the leading end portion from the remainder to complete the sleeve, gripping means for gripping the opened leading end of the sleeve and drawing the sleeve onto stretching means, the stretching means being operable to stretch the sleeve to a size greater than the pack or article that it is required to wrap, means for inserting the pack or article into the stretched sleeve, and discharge means for drawing the sleeve and the pack or article in unison away from the stretching means.

According to the invention there is still further provided a packaging machine for wrapping an article or an array of articles in a stretch-wrap sleeve comprising means for drawing the leading end portion from a supply of flattened stretch-wrap tubing along a first path in a first direction and simultaneously opening out the drawn tubing, means for displacing the leading end portion of the opened out tubing transversely of the first path into a second path parallel to the first path, means for drawing the leading end portion of the tubing along the second path in the first direction on to a pair of separators, means for severing the opened out tubing to leave a sleeve on the separators, means for relatively displacing the separators away from one another in a direction transversely of the second path to stretch the sleeve, means for displacing a said article or array of articles between the displaced separators in a second direction opposite to the first direction, means for moving the separators towards one another to allow the sleeve to shrink more closely around the article or array of articles, means for simultaneously displacing the sleeve and article or array of articles along the second path in the second direction away from the separators to allow the sleeve to shrink still further to tightly wrap the article or array of articles, and means for discharging the wrapped article or array of articles from the second path.

BRIEF DESCRIPTION OF THE DRAWINGS

A packaging machine embodying the invention will now be described, by way of example, with reference to the diagrammatic drawings accompanying the provisional specification in which.

DESCRIPTION OF THE PREFERRED EMBODIMENTS

The machine to be described is arranged to package an article or an array of articles in a sleeve of a low density polyethylene. The low density of polyethylend sleeve is drawn from a roll of low density polyethylene tubing. The leading end portion of the roll is opened out, gripped and drawn over a pair of separating plates and then severed from the remainder of the roll. The separating plates are then opened out to stretch the sleeve while the article or array of articles is fed between the separating plates. The sleeve and the articles are then gripped and withdrawn from between the plates whereupon the sleeve, released from the constraint of the separating plates, shrinks to grip the article or array of articles that it encloses.

FIGS. 1 to 4 show different stages in the operation of a packaging machine which performs the above described method on an article in the form of a pack 51 of biscuits.

Figure 1:
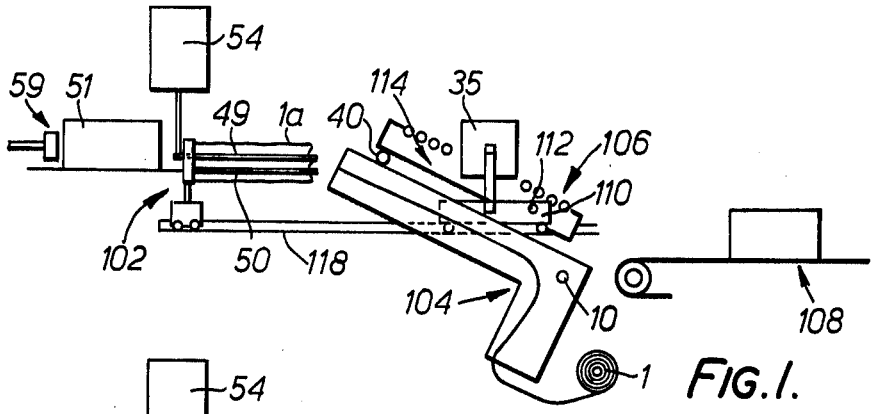
FIGS. 1 to 4 are side elevations of the general machine in different operative states.

As shown in FIG. 1, the machine includes a pair of separating plates 49 and 50 (closed together) carrying a loose sleeve 1*a* of plastics, which is gripped at its left hand end as viewed in FIG. 1, by a gripper assembly 102. The sleeve has just been fed to the plates 49 and 50 by a sleeve feeding and severing assembly 104 which has withdrawn the sleeve from a roll of tubular plastics 1. The upper plate 49 is supported by the piston rod of a piston and cylinder assembly 54. A carriage assembly 106 for discharging a sleeved article or array of articles lies at the right hand end of the machine having just discharged a sleeved article or array of articles onto an endless belt discharge conveyor 108.

The sleeve feeding and severing assembly 104 as shown in FIG. 1 is pivotally supported on a shaft 10 and as shown in FIG. 1 is tilted out of the horizontal with its left hand end, that is the end from which a severed sleeve is discharged, facing the separating plates 49 and 50.

The carriage assembly 106 has a body 110 slidable along rails 118 and initially lies at the right hand end of the machine as shown in FIG. 1. A roller bed 114 which is pivotally mounted on the body 110 by a shaft 112 is held in a tilted attitude by a cam 40 on the sleeve feeding and severing assembly 104. A pair of gripping plates 35 are carried on opposite sides of the body 110 and are movable towards and away from each other to grip and release a package on the roller bed.

In operation, with the machine in the position shown in FIG. 1, the sleeve feeding and severing assembly is pivoted in an anticlockwise sense about the shaft 10. At the same time the roller bed 114, released from the constraint of the cam 40, also pivots in an anticlockwise sense about the shaft 112 until it reaches the horizontal position where it is stopped by the body 110. At this juncture the gripper assembly 102 which has been gripping the sleeve 1*a* releases it.

Figure 2:
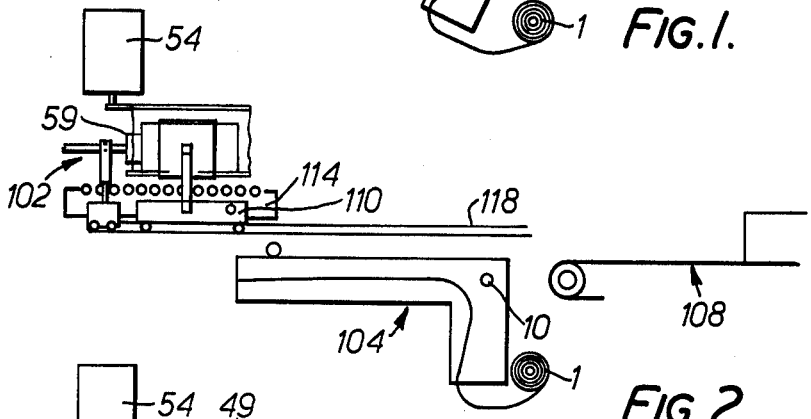
Figure 3:
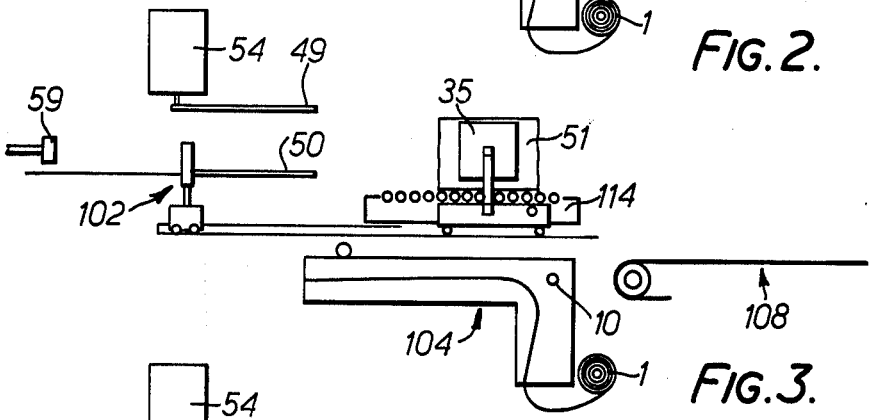

Thereafter the gripper assembly 102, which is also slidable on the rails 118, is moved to the left as viewed in FIG. 1 into the position shown in FIG. 2. At the same time the piston and cylinder assembly 54 is actuated to cause the plate 49 to separate from the plate 50 and so stretch the plastics sleeve to a size larger than that required to accommodate both the separated plates 49 and 50 and the pack 51 to be wrapped. Simultaneously the carriage assembly 106 starts to be driven to the left and the head 59 pushes the pack 51 to the right. The pack 51 is halted after it has completely entered the space between the two plates 49 and 50 and so lies inside the sleeve (see FIG. 2). The carriage is halted when the roller bed 114 underlies the lower separating plate 50 (see FIG. 2).

The gripping plates 35 are now actuated and they move towards one another until they contact the sleeve and urge the sleeve tightly against the pack 51 thus tightly gripping the pack and sleeve. The carriage assembly 106 is then returned to the left hand end as viewed in FIG. 3 to the position shown in FIG. 3. At the same time air is injected between the plates 49 and 50 and the sleeve 1*a* (in a manner to be described in more detail hereinafter) to create a cushion of air on which the sleeve can readily slide off the plates when driven to the right hand side by the carriage assembly 106.

Figure 4:
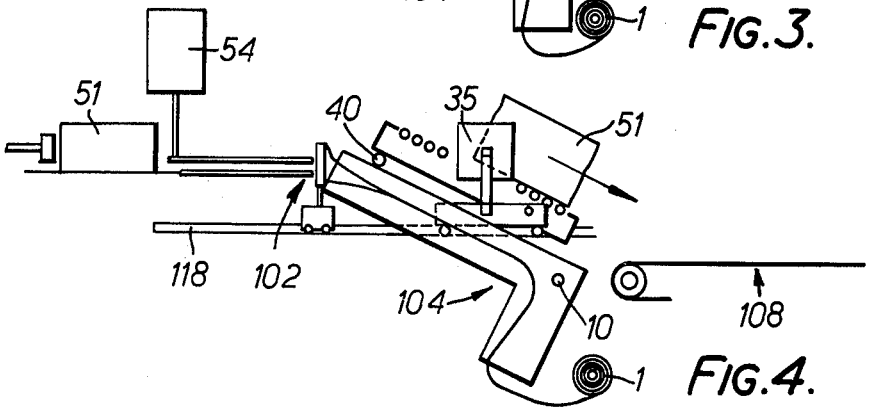

At this stage the plates 49 and 50 are closed together again and the head 59 is retracted to make space for the next pack to be wrapped, (see FIG. 4). Also the gripper plates 35 are separated to release the pack 51 from constraint.

At this time the sleeve feeding and severing assembly 104 pivots in a clockwise sense about the shaft 10 and while doing this opens up the leading end of the tube of plastics. The open end of the tube of plastics thus becomes aligned with the plates 49 and 50 and the gripper assembly 102. The gripper assembly 102 is thereupon displaced to the right hand side up to the open mouth of the plastics tube and is then actuated to grip the open mouth. The gripper mechanism is displaced to the left to draw the open mouth of the tube of plastics progressively over the pair of plates 49 and 50 until it reaches the position shown in FIG. 1. The sleeve feeding and severing assembly 104 then acts to sever the plastics tube to leave the sleeve 1*a* encircling the plates 49 and 50.

When the sleeve feeding and severing assembly is pivoted in a clockwise sense the cam 40 thereon will eventually engage the left hand end portion of the roller bed 114 and progressively pivot the roller bed about the shaft 112. As the roller bed starts to pivot the sleeved pack 51 thereon will run down the slope and so be transferred to the conveyor 108 (see FIG. 4). At this time, the machine is in the state illustrated in FIG. 1 and the cycle is then repeated.

The operation of the various assemblies, in particular the gripper assembly 102, the sleeve feeding and severing assembly 104, and the carriage assembly 106 will now be described in more detail with reference to FIGS. 5 to 8.

The sleeve feeding and severing assembly 102 includes a shaft 3 carrying a pair of core collets 2 which support the roll 1 of flattened polythene tubing. The shaft 3 in turn at each axial end rests on a pair of spaced bearings 4,4 (see FIG. 7) so allowing the shaft 3 to rotate freely. The two pairs of spaced bearings 4,4 are rotatably supported on a frame 6 of the machine.

A braking system 5 is supported on the frame 6 and has a brake shoe 7 which is operable under pneumatic control to engage the outer surface of the shaft 3 and so halt rotation of the roll when there is a danger of the roll overrunning if it picks up too much momentum during intermittant take up of the tubing. Advantageously, the brake shoe carries a curved brake lining of generally complementary curvature to the other circumference of the shaft 3.

Upon leaving the roll 1 the plastics tubing is guided between a pair of horizontally extending freely rotatable rollers which are supported by the frame 6 and thereafter the tubing extends vertically upwardly to pass partially around a horizontal roller 17 supported for free rotation by a subframe 9. The subframe is pivotally connected to the main frame 6 by the shaft 10.

A relatively heavy roller 14 is inserted into the tubular plastics in the section located between the roller 17 and the pair of rollers 7 and 8. The roller 14 is supported by the rollers 7 and 8 so that the two halves of the flattened tube of plastics respectively engage the two rollers 7 and 8 and respectively pass on opposite sides of the roller 14. The function of the roller 14 is to ensure separation of the two halves of the tube of plastics which may have become stuck together by virtue of being tightly wound in the roll for a prolonged period. Accordingly if 'sticking' does occur, the stuck portions of the tube will tend to raise the roller 14 which by virtue of its weight and shape will tend to separate the stuck portions.

The subframe 9 is generally 'Z' shaped and is supported by the shaft 10 at the free end portion of its lower horizontal limb.

The roller 17 is supported at its upper corner while another guide roller 16 is rotatably supported at its lower corner. The upper horizontal limb of the subframe 9 carries a sleeve opening assembly 11 and cutting assembly 12.

A pneumatic piston and cylinder arrangement 13 is arranged to effect the pivoting of the subframe 9 about the shaft 10.

The sleeve opening assembly 11 includes two rotatable spaced guide rollers 18*a*,18*a* rotatably supported by the upper limb of the subframe 9. The two guide rollers 18*a*,18*a* both guide the underside of the flattened plastics tube along the upper limb. The upper limb of the subframe 9 also carries a roller frame 19 which is pivotally supported on the subframe 9 by means of a shaft 20. The roller frame 19 carries a pair of rollers **18*b*,18*b* respectively aligned with the rollers 18*a*,18*a* with the rollers 18*b* and 18*b* lying in the opposite side of the flattened plastics tube to the rollers 18*a* and 18*a*. The roller frame 19 is pivotal between an open position to provide a substantial clearance between the two sets of rollers 18*a*,18*a* and 18*b*,18*b* and a closed portion in which there is minimum predetermined clearance between the pairs of adjacent rollers 18*a*,18*b* and 18*a*,18*b*. The roller frame 19** can be locked in its closed position by toggle latches (not shown).

Located inside the plastics tubing and imprisoned by the two pairs of rollers **18*a*,18*b* and 18*a*,18*b* (when the roller frame 19 is in a closed position) is a sleeve opening device 22. The device includes a generally flat plate 21 (see FIG. 7) supporting on each side two rollers 18*c*,18*c* and 18*d*,18*d*. The two rollers 18*c* and 18*c* lie adjacent respective ones of rollers 18*b* and 18*b* and the two rollers 18*d* and 18*d* lie adjacent respective ones of rollers 18*a* and 18*a*. The rotary axes of the rollers 18*a*,18*a*, 18*b* and 18*b* lie along four parallel edges of an outer imaginary rectangular box. Similarly the rotary axes of the rollers 18*c*, 18*c*, 18*d* and 18*d* lie along the four parallel edges of an inner imaginary box which lies within the outer imaginary box. In this way the rollers of the inner box are held captive against longitudinal and vertical movement by the rollers of the outer box. At the same time the co-operation of the rollers with each other eases the passage of the plastics tube between the two rectangular boxes. To release the plate 19 and the rollers forming the inner box, the roller frame 19 is unlatched and pivoted into its open position. This allows the plate 19** and its rollers to be serviced and inserted into a fresh plastics tube when the supply of the old tube has been exhausted.

The downstream end of the plate 19 is suitably profiled to initiate separation of the two halves of the flattened tube. The upstream end of the plate 19 carries a pair of opening flaps 27,27 which are biased apart by a spring (not shown). The opening flaps 27,27 serve to form the plastics tube into a generally rectangular configuration and so provide two vertical sides which can be readily located and gripped by the gripping assembly 102.

As already described the plate 21 is held captive against vertical and longitudinal movement by the co-operation of the four rollers **18*a*,18*a*, 18*b* and 18*b* with the four rollers 18*c*, 18*c*, 18*d* and 18*d*. However, the plate 21 is free to move laterally in response to the changing forces placed on it by the plastics tube. To mitigate any migration of the plate away from a central position, there is provided a centralising assembly which is periodically actuated to centralise the plate 21. The centralising assembly includes two piston and cylinder arrangements 64 located below the plate 21 at its downstream end and facing opposite side edges of the plate. The piston rod of each arrangement 64 carries a pad (for example of cork or rubber) so that when the arrangements 64 are actuated the pads are shot towards the plate 21 and together act on the opposite side edges of the plate 21 through the plastics tube to centralise both the plate 21** and the tube.

The cutting assembly 12 which is also carried by the subframe 9 includes a pair of clamping jaws 23 and 24. The two jaws are coupled together by a toggle assembly 26 for actuation by a piston and cylinder arrangement 25 to open and close the jaws. The toggle assembly 26 ensures equal movement of the two jaws when opening and closing. Both jaws each have a projecting portion (not shown) which co-operates with a respective one of the opening flaps through the plastics tube so that when the jaws are closed the flaps 27 and 27 are also closed against the bias of the spring (not shown) and when the jaws open the flaps 27,27 are allowed to open under the bias of the spring. The lips of the two jaws which are arranged to clamp the plastics tube between them, when the jaws are closed, each have a central transversely extending slot. The two slots co-operate so as to provide a space for a cutter to act on the clamped tube. The lower jaw 24 supports such a cutter 28 having a saw toothed cutting edge. The cutter is actuated in response to a pair of piston and cylinder arrangements 29 which support the cutter 28 at opposite ends and when actuated move the cutter through the slot in the lip of the lower jaw 24 into the slot in the lip of the upper jaw 23 and in so doing progressively sever the plastics tube transversely. Advantageously the two lips are lined with a resilient material such as rubber so as to ensure a firm and even clamping action on the plastics tube.

As already described in connection with FIG. 1 the machine has a pair of longitudinally extending guide rails 118, 118. These rails are supported on opposite longitudinal sides of the main frame. The gripper assembly 102 and the carriage assembly 106 both run on these rails 118,118.

The gripper assembly 102 has a main cross head 42 extending transversely of the machine. A pair of rollers 48,48 are located at each of the two opposite transverse ends of the cross head 42 and engage a respective one of the two rails 118 and 118. A pair of film pickup assemblies 44 are located one adjacent each of the two opposite transverse ends of the cross head 42. Each assembly 44 includes a pair of clamping plates 45 and 46 which are operated to open and close by a corresponding piston and cylinder arrangement 43. In each case the clamping plate 46 is fixed while the clamping plate 45 is moved by the piston and cylinder arrangement 43.

Advantageously the facing surfaces of each pair of clamping plates 45 and 46 are lined with rubber pads, the two pads of each pair of plates 45 and 46 having mating corrugations. Instead one pad of each pair can be of rubber and the other pad of each pair can have a rough abrasive surface to ensure a good clamping action.

The locations of the piston and cylinder assemblies 44 on the cross head 42 are adjustable to enable the gripper assembly to cope with different sized tubes.

Figure 7:
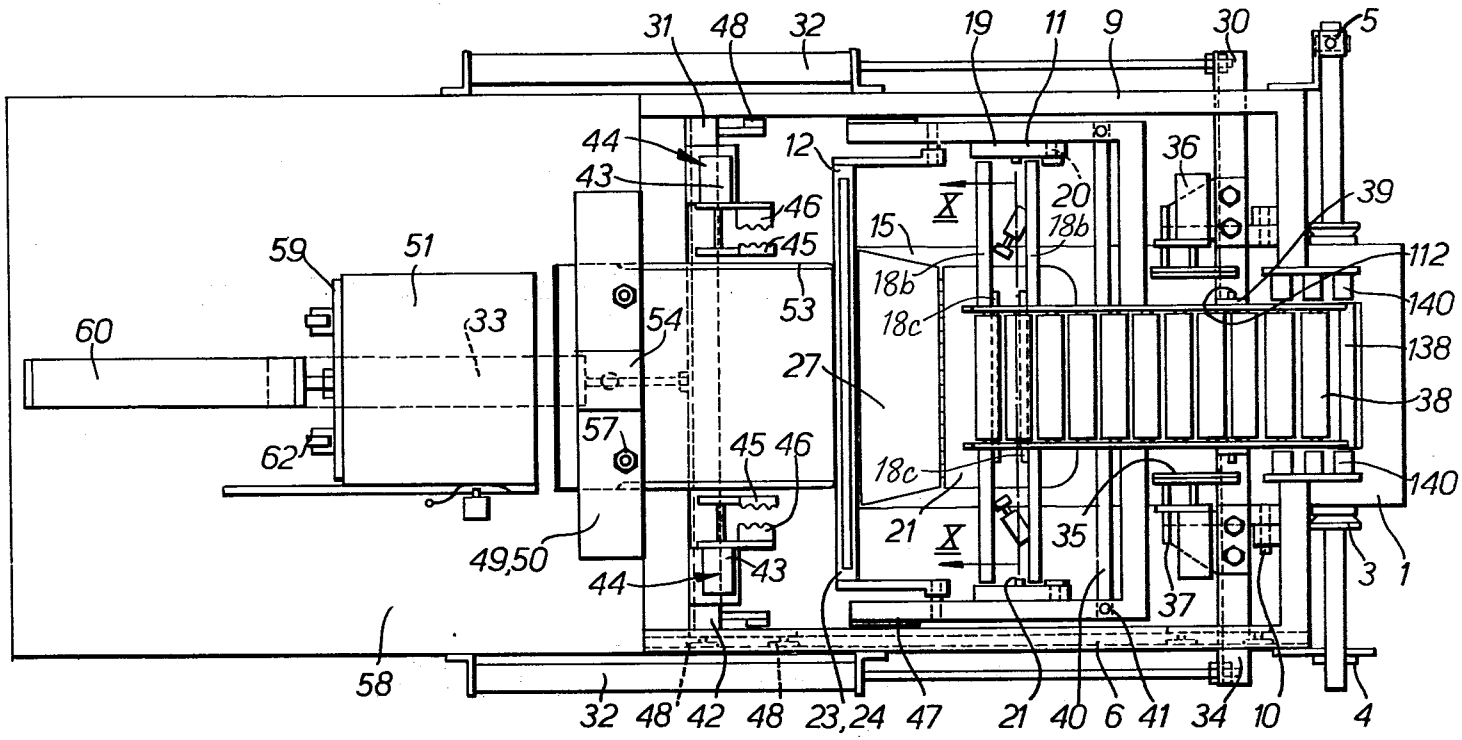
FIG. 7 is a plan view of the machine of FIG. 5.

The trailing or downstream roller of each pair of rollers 48,48 supporting the cross head 42 lies downstream of the downstream extremities of the clamping plates 45 and 46 and are respectively arranged to lie directly below a pair of cams 47,47 mounted at opposite lateral sides of the upstream end of the subframe 9, when the subframe lies in its raised position and the crosshead lies in its extreme right hand position as viewed in FIG. 7. In this way, if the subframe 9 is dropped from its raised towards its lowered position (for example due to a failure in the piston and cylinder arrangement 13) when the cross head 42 is in its extreme right hand position, then the cams 47,47 drop onto respective rollers 48,48 which hold the subframe 9 up and prevent the jaws 23 and 24 from crashing down on the clamping plates 46 and 45. If at this time the cross head 42 is displaced leftwardly the downstream rollers 48 will maintain support for the subframe 9 until the clamping plates 45 and 46 have cleared the locus of the jaws 23 and 24 whereupon the cams 47 will disengage the rollers 48 and the subframe will be allowed to resume its movement towards its lowered position.

The profile of the cams 47 is such that if the subframe 9 is raised with the cross head in its most right hand position, they will engage the rollers 48 and displace the cross head leftwardly by an amount sufficient to allow the jaws 23 and 24 to clear the clamping plates 45 and 46 whereupon the cross head will be allowed to resume its previous position.

The cross head 42 is reciprocated along the rails 118,118 by a piston and cylinder arrangement 33.

Figure 5:
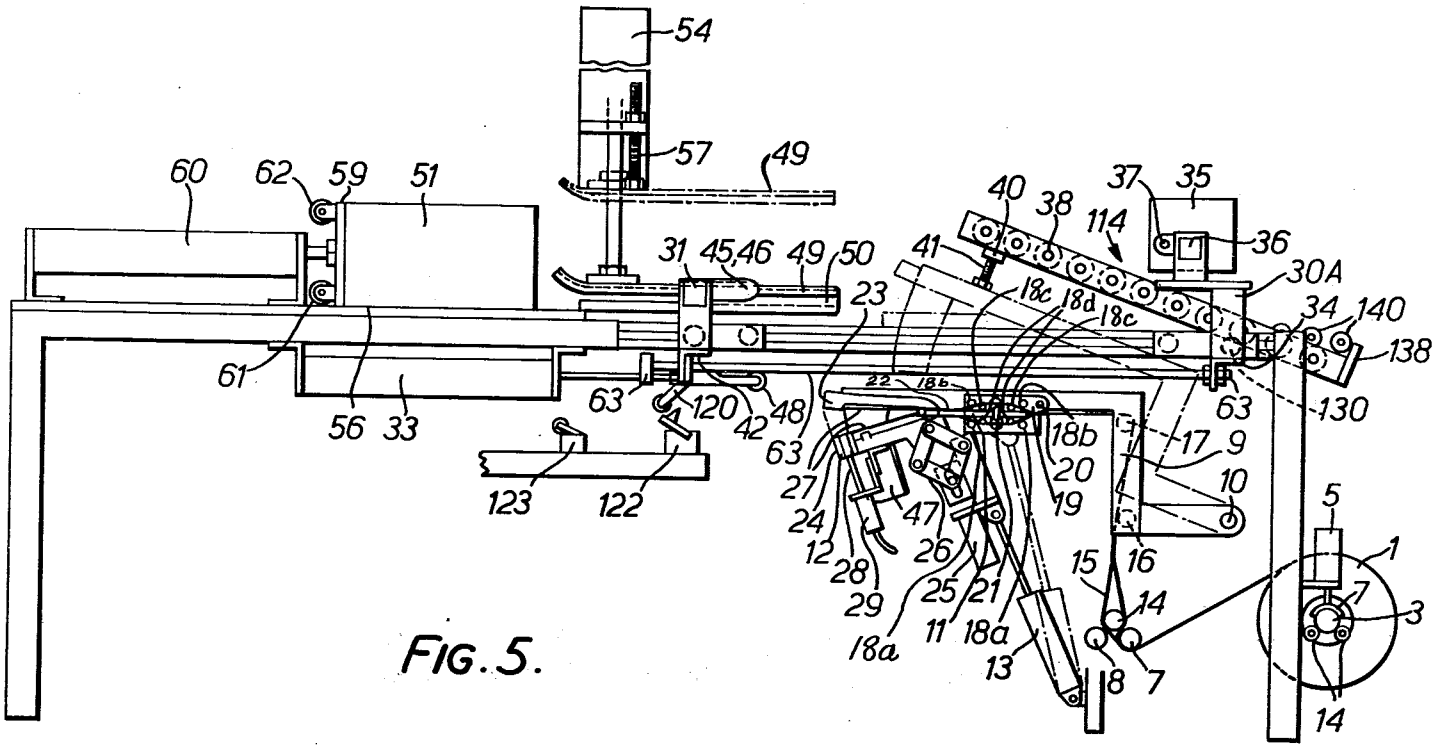
FIG. 5 is a fragmentary side elevation showing the machine of FIGS. 1 to 4 in more detail and to a larger scale.
Figure 6:
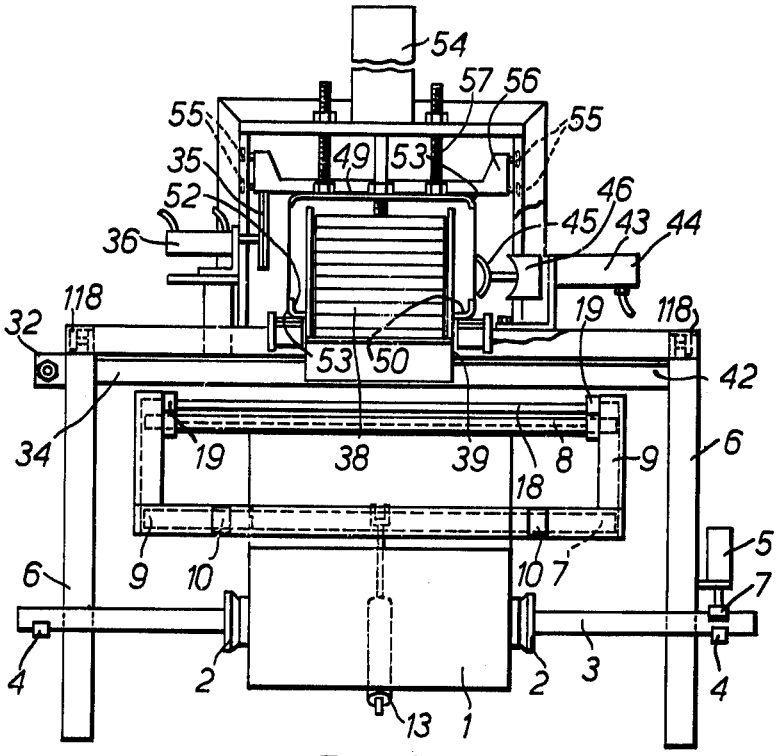
FIG. 6 is an end elevation of the machine of FIG. 5.
Figure 8:
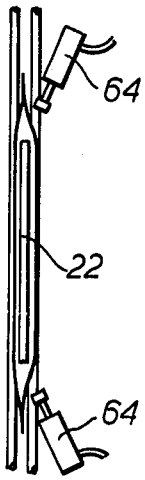
FIG. 8 is a fragmentary section taken on the line X—X of FIG. 7.

The cross head 42 carries a switch tripping finger 120 which is arranged to trip two switches 122 and 123 in succession when the cross head is displaced rightwardly as viewed in FIG. 5.

The carriage assembly 106 has a body member 110 which includes a transversely extending cross head 34 carrying at opposite transverse sides a pair of pillars 30. Each pillar 30 supports a piston and cylinder arrangement 36 controlling a corresponding one of the two gripping plates 35. The cross head 34 carries two pairs of rollers 130, 130 and 130, 130, one pair located at each of the two opposite transverse ends of the cross head 34. Each pair of rollers 130, 130 engages a corresponding one of the guide rails 118. The extreme end portions of the cross head extend beyond the confines of the guide rails and are coupled to a pair of piston and cylinder arrangements 32 mounted on the frame 6 and which when actuated reciprocate the carriage along the guide rails 118, 118. The roller bed 114 has a plurality of rollers 38 and a pair of brackets 39 which can pivot about the shaft 112. The cam 40 previously mentioned is in the form of a bar which is supported by two screwthreaded members 41 screwthreadedly engaging the subframe 9. It will be appreciated that by rotating the screwthreaded members 41, the height of the bar 40 can be adjusted as desired.

At the right hand end of the roller bed, there is an end stop 138 which limits the movement of a pack carried by the roller bed. In order to prevent the stop 138 inhibiting the discharge of the pack, two sets of rollers each having three rollers 140 are located on opposite transverse sides of the downstream end of the roller bed. These two sets of rollers 140 are mounted on the main frame 6 and are so arranged that when the roller bed is horizontal the upper surfaces of the rollers 140 are generally level with that of the rollers 38. This means that the end stop 138 will still project above the rollers 140. Also the roller bed is arranged at least at the downstream end to be narrower than a said pack which it supports so that when the carriage 106 is moved to the extreme right hand end carrying a pack, the pack will partly rest on the rollers 140. If now the roller bed is tilted as hereinbefore described, the end stop 138 will move downwardly to clear the upper level of the rollers 140 and so free the pack for movement down the roller bed.

The gripping plates 35 have their facing surfaces lined with pads of a resilient high friction material to ensure a positive gripping of the pack and the sleeve. In addition each plate has a guide hole which is slidably engaged by rod 37 secured to the cylinder of its corresponding piston and cylinder arrangement 36. In this way the plate 35 which is otherwise only supported by the piston rod of its corresponding cylinder and piston arrangement is prevented from rotating.

Two longitudinally extending rods 63 are secured to the cross head 34. Each rod extends to the left as viewed in FIG. 5 and passes through a corresponding guide hole in the cross head 42. At the end of each rod 63 on the opposite side of the cross head 42 to the cross head 34 there is a stop. The stops act to limit the maximum degree of relative movement between the cross heads 34 and 42.

The two separating plates 49 and 50 as previously mentioned are controlled by the piston and cylinder arrangement 54. Each plate is generally flat but has curved longitudinal edges 52 which are arranged to guide the four longitudinal edges of the pack and to hold the stretched sleeve away from the edges while the pack is being fed between the plates. Running along the apex of each of the curved edges 52 is a conduit 53 provided with a plurality of longitudinally spaced holes. Each conduit 53 is connected to a source of air (not shown) which is selectively controlled to periodically produce a cushion or partial cushion of air between the four edges 52 and the sleeve.

The head 59 which as previously mentioned drives the pack 51 between the plates 49 and 50 when open is actuated by a piston and cylinder arrangement 60. The head 59 has a pair of lower rollers 61 which run on a surface that forms an extension of the lower plate 50 and thus reduces any stress on the piston rod when the piston is fully extended. The head 59 also has a pair of upper rollers 62 which project above the upper surface of the head. In this way, when the head 59 is located between the opened plates 49 and 50 and the opened plates are inadvertently closed (for example by a failure in the piston and cylinder assembly 54) the upper piston will fall onto the rollers 62 and then when the head 54 is subsequently retracted there will be no danger of the head 59 scraping and so damaging the under surface of the plate 49.

The operation of the machine will now be described again but in more detail.

Initially the head 59 is in a retracted pisiton with a pack 51 located between the head 59 and the separating plates 49 and 50. The two separating plates are spaced apart and stretch a previously applied sleeve 1*a*. The subframe 9 is in the lowered position and the roller bed 114 lies directly below the lower plate 50.

The piston and cylinder arrangement 60 is actuated in response to operation of a start button (not shown) and the head 59 displaces the pack 51 between the two plates 49 and 50 until it is correctly positioned in relationship to the sleeve.

When the head 59 reaches the limit of its extension it triggers a switch (not shown) which actuates the two piston and cylinder arrangements 36 to drive the gripper plates 35 towards one another until they grip both the sleeve and the pack. When a predetermined gripping force is achieved as sensed by a sensor (not shown), the sensor acts to actuate the source supplying the cushion of air between the sleeve and the separating plates and to actuate the two cylinders 32 to displace the carriage assembly to the right hand side as viewed in FIG. 5. The pack 51 and the sleeve 1*a* are thus dragged clear of the separating plates 49 and 50. As soon as the pack has cleared the plates the carriage assembly trips a switch (not shown) and the air supply supplying the cushion of air is discontinued while the piston and cylinder arrangement 54 is de-actuated to lower the upper plate 49.

When the carriage assembly reaches the limit of its right hand stroke yet another switch is tripped which actuates the piston and cylinder arrangement 13 and also de-actuates the piston and cylinder arrangement 36,36. This latter action causes the plates 35 to release the pack 51. When the arrangement 13 is actuated the subframe 9 is accordingly pivoted upwardly which in turn causes the roller bed 114 to pivot. As soon as the roller bed has pivoted sufficiently for the end stop 138 to clear the upper level of the rollers, the pack 51 is released and is discharged under gravity.

At the same time as the piston and cylinder arrangement 13 is tripped, so also are the piston and cylinder arrangements 29,29 and 33. As a result as the subframe 9 rises and the jaws 23 and 24 are opened to release the flaps 27,27 from constraint. The flaps 27,27 accordingly open under the bias of the spring to open the free end of the plastic tube. As soon as the subframe reaches its upper limit, the clamping plates 45 and 46 align themsleves on the opposite sides of the open end portion of the tube. When the cross head 42 reaches the limit of its rightward movement (as viewed in FIG. 5), it trips still another switch (not shown) to actuate the piston and cylinder arrangements 43,43 which thereupon move the plates 45,45 outwardly to tension the open end portion, and thereafter clamp it to respective plates 46,46. There is therefore no slackness in the open end portion of the tube.

When the piston and cylinder arrangements 43 and 43 reach their limit of extension they trip a further switch (not shown) which de-actuates the piston and cylinder arrangement 33 to displace the cross head 42 leftwardly. As a result, the clamping plates 45 and 46 draw the tubing through the subframe 9 from the roll 1 and the open end of the tube is drawn onto the closed separating plates. The leftward movement of the cross head 42 is halted when it engages abutments on the rods 62 since the piston and cylinder arrangements 32 together are more powerful than the arrangement 33. At this point the finger 120 on the cross head 42 trips the switch 122 which actuates the piston and cylinder arrangement 5 to brake the roll 1 against further rotation. The switch 122 also actuates the piston and cylinder arrangement 25 to close the jaws 23 and 24. The flaps 27,27 are thereupon urged together and the plastics tube clamped just upstream of the flaps 27,27. Closure of the jaws 23 and 24 trip yet another switch (not shown) which actuates the piston and cylinder arrangements 29,29 to perform a forward and return stroke. In so doing the knife 28 severs the tube. As the piston and cylinder arrangements complete their return stroke they trip another switch (not shown) which de-actuates the piston and cylinder arrangement 13 and actuates the piston and cylinder arrangement 33,33. As a result, the subframe 9 is lowered and in doing so allows the roller bed 114 to return to the horizontal. At the same time the carriage assembly is moved leftward. This releases the cross head 42 which continues to move leftward until it clears the plates 49 and 50. During its final movement the finger 120 trips a switch 123 which cause the clamping plates to release the now severed sleeve in an appropriate position on the plates 49 and 50. Meanwhile the carriage assembly continues its movement until the roller bed 114 is brought just beneath the lower plate 50. As the cross head 34 approaches its extreme left hand position it trips yet another switch (not shown) which actuates the piston and cylinder arrangement 54 and so raises the plate 49 to stretch the sleeve.

The machine is now ready for another cycle.

It will be appreciated that when the plate 49 is raised it is advantageous to supply an air cushion between the plates and the sleeve for a short duration to allow stretching stress all around the sleeve to be equalised and thus reduce the danger of the sleeve rupturing.

It will also be appreciated that where the pack 51 has smooth rounded leading edges, the separating plates 49 and 50 can have a shorter length than the pack itself since after the pack is passed between the plates it can engage the trailing end of the sleeve and stretch the same readily with its leading corners. Where, however, the pack has sharp or rough corners, it is desirable that the plates 49 and 50 should have the same length as the pack.

The machine described performs a stretch-wrap exercise. Most stretch-wrap plastics tubing has stretch-wrapping properties which are different for the different directions in which the tubing is stretched. In most tubes recovery upon being stretched axially is greater than that achieved while being stretched circumferentially. In such situations, the axial ends of the sleeve after being stretched onto a pack are somewhat loose and may need the application of heat shrinking techniques to ensure a firm closure of the pack 51 at opposite axial ends. It is therefore desirable that plastics tubing be used having greater recovery upon being stretched circumferentially than axially.

The cushion of air supplied to the separating plates can include a suspension of vegetable oil or French chalk dust to improve the insertion of the pack into the sleeve.

In a modification the plastics tubing can be appropriately perforated at regular intervals to enable predetermined lengths of sleeve to be readily torn off. With such an arrangement the jaws and cutter can be omitted although some form of retarding mechanism should be provided to ensure that only one sleeve is torn off at a time.

Many modifications can be made to the invention without departing from the spirit and scope of the invention as defined by the appended claims.

We claim:

1. A packaging machine for wrapping an article or pack in a sleeve of stretch-wrap material, comprising means for receiving the sleeve of stretch-wrap material and opening it at one end, sleeve stretching means for entering the open end of the sleeve and operable to stretch the sleeve to a size sufficient to accommodate the article or pack to be wrapped by the sleeve, means for moving the article or pack relative to the stretching means so that the article or pack is accommodated within the sleeve, gripping means for gripping both the article or pack and the sleeve, and control means for moving the gripping means and stretching means relative to one another to free the sleeve wrapped article or pack from the stretching means.

2. A packaging machine for wrapping a pack or article in a stretch-wrap sleeve taken from a supply of stretch-wrap tubing, comprising a frame, a sleeve feeding and cutting assembly mounted on the frame for drawing the leading end portion from a supply of stretch-wrap tubing, for opening the leading end, and for severing the leading end portion from the remainder to complete the sleeve, gripping means mounted on the frame for gripping the opened leading end of the sleeve and drawing the sleeve to encompass a predetermined location, stretching means mounted on the frame at the predetermined location and operable to stretch the sleeve to a size greater than the pack or article that it is required to wrap, insertion means mounted on the frame for inserting the pack or article into the stretched sleeve, a track mounted on the frame, a carriage movable along the track between a first position in which it underlies the stretching means to a second position remote from the first position, discharge means mounted on the carriage for engaging the sleeve and the pack or article when the carriage is in the first position and for drawing the sleeve and the pack or article in unison away from the stretching means, when the carriage is moved towards the second position, a roller bed pivotally supported on the carriage and on which the pack or article is to be carried, and means mounted on the frame for tilting the roller bed when the carriage reaches the second position thereby to discharge the pack or article.

3. A machine according to claim 2, wherein the sleeve feeding and cutting assembly includes a separating plate arranged to be located within the tubing, and a roller cage assembly located outside the tube and mounted on the frame to hold the separating plate captive against movement both longitudinally and in a direction at right angles to the tube.

4. A machine according to claim 3, including centralising means mounted on the frame and actuatable periodically to displace the separator plate transversely of the tube into a predetermined transverse location.

5. A machine according to claim 2 wherein the sleeve feeding and cutting assembly lies below the carriage when in the second position, the assembly being pivotally supported on the frame so as to be tiltable during the sleeve opening operation from a first angular position into a second angular position to present the open end of the sleeve to the sleeve gripping means and whereby to act as the means for tilting the roller bed.

6. A machine according to claim 2, wherein the gripping means comprises two pairs of clamping plates, each pair of clamping plates having mating undulating surfaces.

7. A packaging machine for wrapping an article or an array of articles in a stretch-wrap sleeve taken from a supply of flattened stretch-wrap tubing, comprising a frame, first means mounted on the frame for drawing the leading end portion from the supply of flattened stretch wrap tubing along a first path in a first direction and simultaneously opening out the drawn tubing, second means mounted on the frame for displacing the leading end portion of the opened out tubing transversely of the first path into a second path parallel to the first path, third means mounted on the frame for drawing the leading end portion of the tubing along the second path in the first direction onto a pair of separators, fourth means mounted on the frame for severing the opened out tubing to leave a sleeve on the separators, fifth means mounted on the frame for relatively displacing the separators away from one another in a direction transversely of the second path to stretch the sleeve, sixth means mounted on the frame for displacing a said article or array of articles between the displaced separators in a second direction opposite to the first direction, seventh means mounted on the frame for moving the separators towards one another to allow the sleeve to shrink more closely around the article or array of articles, eighth means mounted on the frame for simultaneously displacing the sleeve and article or array of articles along the second path in the second direction away from the separators to allow the sleeve to shrink still further to tightly wrap the article or array of articles, and ninth means mounted on the frame for discharging the wrapped article or array of articles from the second path.

8. A packaging machine according to claim 7, wherein the first means includes a separating plate arranged to be located within the tubing, and a roller cage assembly located outside the tube and mounted on the frame to hold the separating plate captive against movement both longitudinally and in a direction at right angles to the tube.

* * * * *